United States Patent [19]

Koba et al.

[11] Patent Number: 4,586,485

[45] Date of Patent: May 6, 1986

[54] HEATING DRUM FOR RADIANT HEATER AND METHOD OF MANUFACTURE THEREOF

[75] Inventors: Yositaka Koba, Ibaraki; Yoshiki Hayashi, Settsu; Kunikazu Torikoshi, Osaka, all of Japan

[73] Assignee: Daikin Kogyo Co., Ltd., Osaka, Japan

[21] Appl. No.: 618,900

[22] Filed: Jun. 8, 1984

[30] Foreign Application Priority Data

Nov. 11, 1983 [JP] Japan ..... 58-212989
Nov. 11, 1983 [JP] Japan ..... 58-212990
Nov. 11, 1983 [JP] Japan ..... 58-212991

[51] Int. Cl.[4] ..... F24C 1/00

[52] U.S. Cl. ..... 126/248; 126/92 B; 126/93

[58] Field of Search ..... 126/92 R, 92 AC, 92 B, 126/92 C, 93, 97, 248, 259 M

[56] References Cited

U.S. PATENT DOCUMENTS 1,037,036 9/1912 Peterson ..... 104/105
1,666,233 4/1928 Campbell ..... 126/93
1,935,845 11/1933 Hader ..... 126/92 B
2,596,329 5/1952 Egbert ..... 126/248
3,240,256 3/1966 Binkley et al. ..... 126/93
4,140,100 2/1979 Ishihara ..... 126/92 B

*Primary Examiner*—Margaret A. Focarino
*Attorney, Agent, or Firm*—Birch, Stewart, Kolasch & Birch

[57] ABSTRACT

An heating drum for use in a radiant heater having a burner for the combustion of fuel, which comprises an axially corrugated barrel made of steel material and forming therein a generally cylindrical inner chamber and a plurality of annular chambers communicated with the cylindrical inner chamber and alternating with concave exterior spaces over the length thereof. The cylindrical inner chamber is defined by furrow-defining walls while each of said annular chambers is defined by a ridge-defining wall and opposedly inclined first and second annular side walls on respective sides of the associated ridge-defining wall. The barrel has one end closed and the other end adapted to seat over the burner and also has first circumferential rows of combustion gas outlet perforations, the combustion gas outlet perforations of each row being defined in at least one of the first and second annular side walls for each annular chamber.

11 Claims, 11 Drawing Figures

HEATING DRUM FOR RADIANT HEATER AND METHOD OF MANUFACTURE THEREOF

BACKGROUND OF THE INVENTION

The present invention generally relates to a radiant heater or stove and, more particularly, to a heating drum adapted to seat over a burner of the radiant heater or stove for enhancing the heating of the combustion gas at lower ambient air temperature with high radiant efficiency.

The prior art heating drum so far found closest to the present invention is disclosed in the U.S. Pat. No. 1,037,306, patented on Sept. 3, 1912. The heating drum disclosed therein is shown as comprising an axially corrugated barrel having one end obviously closed and provided with a handle and the other end formed integrally with a hood adapted to seat over the burner, said hood having a downwardly flared flange integral therewith. The barrel so axially corrugated forms therein a generally cylindrical inner chamber and a plurality of axially equally spaced annular chambers communicated with the cylindrical inner chamber and alternating with concave spaces over the length thereof. For throwing heating air inside the heating drum off therefrom, the barrel is provided with gas outlet openings. These gas outlet openings are, according to the patent now under discussion, defined on the outermost periphery of each of the walls defining the respective annular chambers and opened in a direction essentially perpendicular to the longitudinal axis of the barrel.

The patent in question also discloses the side openings defined in the downwardly flared flange so as to open diagonally upwards for the introduction of air exteriorly of the heating drum into the interior of the heating drum during the combustion of fuel taking place in the burner.

It appears that the above mentioned patent has been directed to an improvement of a perforated heating drum of right cylinder in shape for the purpose of enabling a relatively large space to be heated in a relatively short time by forcing the heated air inside the barrel to be thrown out through the gas outlet openings in a direction radially and outwardly of the heating drum. Considering the particular location of the gas outlet openings in the heating drum and also the presumed, but obvious purpose for which it has been provided, taken together with the illustrated longitudinal sectional representation of the annular chambers, each of the gas outlet openings is obviously so positioned and so oriented that the heated gas inside the barrel can be thrown out through the respective gas outlet opening at a high speed as if a fluid medium were force outwards from a nozzle. As is well known to those skilled in the art, any fluid medium emerging outwards through any constricted opening draws the ambient air to meet with it. This phenomenon takes place even in the heated gas stream emerging outwardly each gas outlet opening, with the consequence that the thermal boundary layer is so reduced in thickness as to result in the retarded heating of the heating drum itself, although the heated gas appears to reach a relatively long distance.

Moreover, since the side openings in the downwardly flared flange are utilized to draw the ambient air into the interior of the heating drum to mix with the products of combustion prior to being emitted to the outside through each gas outlet opening, the heated gas inside the heating drum tends to be inevitably cooled in admixture with the fresh air introduced thereinto through the side openings and, therefore, it is quite obvious that the temperature of the heating drum tends to be reduced correspondingly.

It is to be noted that, if the temperature of the surface from which heat energy is radiated is low, a given load of combustion energy will not be efficiently converted into radiant energy as is the case with the convection heating system. Furthermore, when it comes to the corrugated or bellows-like heating drum, the upflow current of heated gas tends to receive a relatively great resistance and, accordingly, unless care is taken such as embodied in the present invention, the heated gas inside the heating drum tends to be distributed unevenly inside the heating drum with the result that a lower portion of the drum adjacent to the burner will be excessively heated as compared with the other portion thereof.

Although less pertinent to the present invention, another U.S. Pat. No.4,140,100, patented on Feb. 20, 1979, discloses a radiant heater of horizontal model wherein a horizontally lying doubled heating cylinder assembly is employed with the burner assembly positioned adjacent to one end thereof. The doubled heating cylinder assembly disclosed therein comprises perforated outer and inner cylinders coaxially positioned one inside the other, the perforations in the outer cylinder being arranged out of alignment with and in offset relation to the perforations in the inner cylinder in a direction both circumferentially and axially of the heating cylinder assembly.

In view of the horizontal model susceptible to the problem in which the central portion of the heating cylinder assembly is more difficult to heat than the opposite end portions thereof, the last mentioned patent discloses the recommended arrangement of the perforations in the inner cylinder wherein the ratio of the total open area of the perforations bored at the central portion of the inner cylinder to the open area is higher than that at each end portion thereof for the purpose of facilitating blow off through the perforations of the combustion flame which in turn impinges upon the non-perforated wall of the outer cylinder. As one method to achieve this, it suggests the employment of the perforations in the inner cylinder in a greater number per unit area at the central portion thereof than that at each end portion, the employment of the perforations of greater diameter at the central portion thereof than that of each end portion, and the employment of the perforations of which diameters gradually increase towards the central portion of the inner cylinder.

SUMMARY OF THE INVENTION

Accordingly, the present invention has been developed with a view to substantially eliminating the above described disadvantages and inconveniences inherent in the prior art heating drums and has for its essential object to provide an improved heating drum for use in a radiant heater, which is simple in structure and capable of radiating heat energy substantially uniformly over a relatively large space in a short period of time, thereby contributing to the increased heating efficiency.

For this purpose, the present invention provides an heating drum for use in a radiant heater having a burner for the combustion of fuel, which comprises an axially corrugated barrel made of steel material and forming therein a generally cylindrical inner chamber and a plurality of annular chambers communicated with the cylindrical inner chamber and alternating with concave exterior spaces over the length thereof. The cylindrical inner chamber is defined by furrow-defining walls while each of said annular chambers is defined by a ridge-defining wall and opposedly inclined first and second annular side walls on respective sides of the associated ridge-defining wall. The barrel has one end closed and the other end adapted to seat over the burner and also has first circumferential rows of combustion gas outlet perforations, the combustion gas outlet perforations of each row being defined in at least one of the first and second annular side walls for each annular chamber.

BRIEF DESCRIPTION OF THE DRAWINGS

These and other objects and features of the present invention will readily be understood from the following detailed description of some preferred embodiments of the present invention taken with reference to the accompanying drawings, in which.

DETAILED DESCRIPTION OF THE EMBODIMENTS

Figure 1:
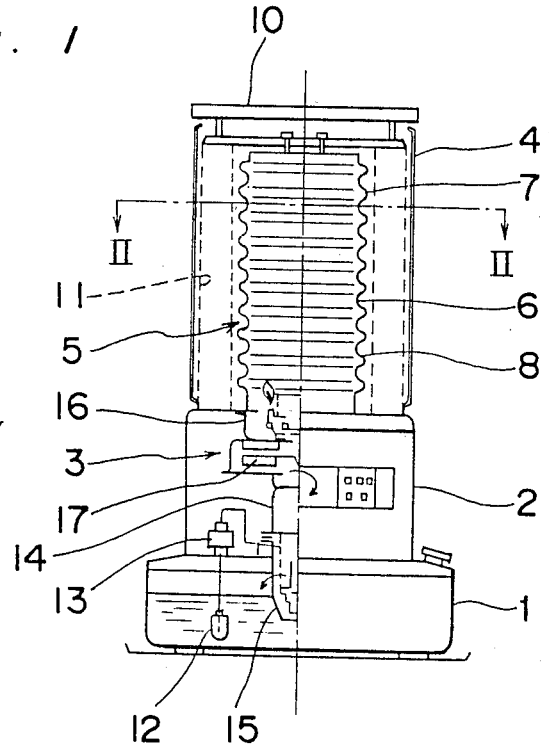
FIG. 1 is a front elevational view of a radiant heater of upright model embodying the present invention, with a left-hand portion thereof being shown in section.

Before the description of the present invention proceeds, it is to be noted that like parts are designated by like reference numerals throughout the accompanying drawings.

Figure 2:
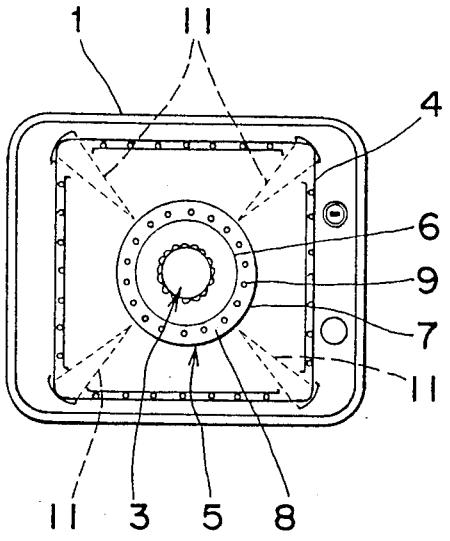
FIG. 2 is a cross sectional view taken along the line II—II in FIG. 1.

Referring first to FIGS. 1 and 2, there is illustrated an upright radiant heater of a type which comprises a fuel tank 1 adapted to be placed on the floor and to contain therein a substantial quantity of fuel or fuels such as fuel oil, a burner enclosure 2 mounted on the fuel tank 1 and protruding upright from the top of the fuel tank 1, a burner 3 disposed within the burner enclosure 2 for burning the fuel which has been gasified in any known manner, a perforated heating drum 5 mounted on the burner 3 and extending upwardly therefrom, a guard screen 4 mounted on the burner enclosure 2 so as to extend upright therefrom and encircling the heating drum 5, and a top panel 10 mounted on one of the opposite ends of the guard screen 4 remote from the burner enclosure 2 and overhanging the top of the heating drum 5. If desired, the radiant heater shown may further comprise corner reflectors 11 (shown by the chain lines) extending over the length of the heating drum 5 and spreading in a direction radially of the heating drum 5.

The radiant heater so far shown also comprises an electromagnetically operated pump 13 for pumping the liquid fuel within the tank 1 through a filter 12 into a pump chamber 15 and then to an evaporator 16 at which the liquid fuel so supplied is gasified. To the evaporator 16, ambient air for combustion is also supplied by a fan 17, driven by an electric motor 14, to mix with the gasified fuel to provide a combustible air-fuel mixture which can be burned at the burner 3 in a manner well known to those skilled in the art. The burner 3 upon the combustion of the combustible air-fuel mixture produces jet flames which flare upward through the interior of the heating drum 5 to heat the latter to a red-hot condition. When the heating drum 5 is so heated, radiant heat energy is emitted therefrom in all directions generally radially of the heating drum 5.

While the present invention is directed to the perforated heating drum 5, other component parts of the radiant heater or stove than the heating drum 5 are well known to those skilled in the art and, therefore, they will not be herein described in detail for the sake of brevity. It is, however, to be noted that, although the radiant heater shown in FIGS. 1 and 2 and connoted in the description herein set forth is a fan-forced upright model, in which the combustion gas is forced into the drum, the heating drum 5 to which the present invention is directed can be equally utilizeable in any other model, for example, a fan-forced horizontal model, and also in any type of heater, for example, an oil heater utilizing one or two cylindrical wicks or a gas heater or stove.

Figure 3:
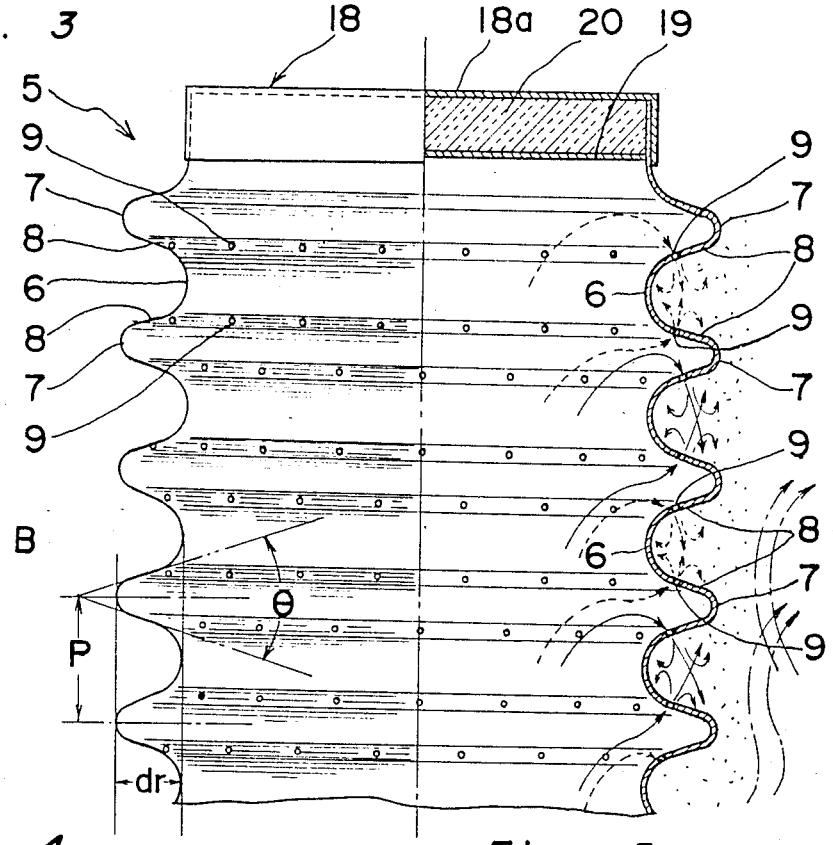
FIG. 3 is a front elevational view, on an enlarged scale, of an upper portion of the heating drum used in the heater of FIG. 1, with a right-hand portion thereof being shown in section.
Figure 4:
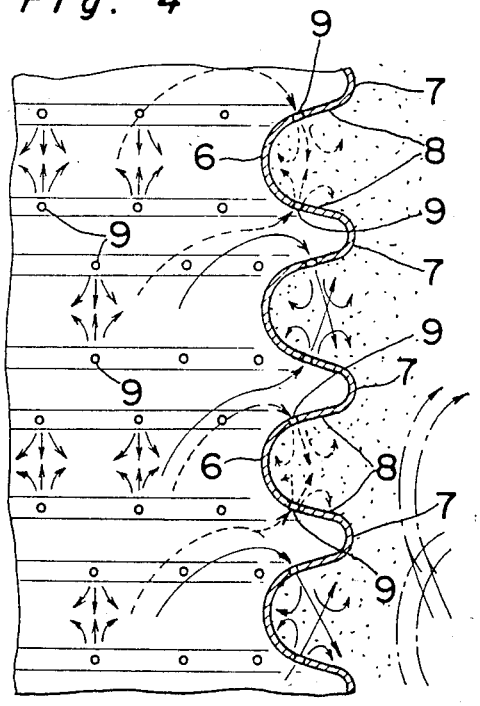
FIG. 4 is a fragmentary sectional view, on a further enlarged scale, of a portion of the heating drum shown in FIG. 3.

Referring now to FIGS. 3 and 4 showing the details of the heating drum 5 according to the present invention, the perforated heating drum 5 comprises a generally cylindrical open-ended barrel B having a lower end adapted to seat over the burner 3 as shown in FIG. 1 and an upper end closed by an insulation hood 18. The heat insulation hood 18 has a generally cup-like configuration and includes a generally disc-shaped layer 20 of any known heat insulating material sandwiched and retained in position between a top panel portion 18*a* and a retainer plate 19. Although not shown, the space between the lower end of the barrel B and a burner flame retaining plate is made in a heat insulating structure to substantially avoid or minimize the conduction of heat in a direction downwardly of the heating drum 5.

The barrel B is of a shape similar to a bellows having walls of sinuous vertical section and is, for this purpose, axially corrugated so as to provide furrow-defining and ridge-defining walls identified generally by 6 and 7, respectively. With the barrel B so corrugated, each furrow-defining wall 6 is contiguous to the two adjacent ridge-defining walls 7 on respective sides thereof, i.e., immediately below and above such furrow-defining wall 6, through a respective pair of opposite annular walls 8 which extend radially outwardly from such furrow-defining wall 6 so as to incline downwardly and upwardly, respectively. It is to be noted that, for the reason which will become clear from the subsequent description, the upwardly and downwardly inclined annular walls 8 on respective sides of each ridge-defining wall 7 are so inclined as to converge at a predetermined angle 8, as will be described later, with each other at the point radially and outwardly from such ridge-defining wall 7.

The annular walls 8 are formed with perforations 9 defined therein, the perforations 9 in each of all of the annular wall 8 being distributed circumferentially of the barrel B in equally spaced relation to each other. The number and size of these perforations 9 are so selected as to be appropriate to the quantity of combustion gases and are determinative of the total open area of openings in the barrel B as a whole. However, some of the annular walls 8 adjacent to the burner 3 have the perforations 9 defined therein in such a number that the total open area thereof may be smaller than that of the perforations 9 defined in some of the annular walls 8 adjacent to the hood 18. By adequately increasing or decreasing the total open area of the perforations 9 over the length of the barrel B, not by making it uniform, it is possible to make the arrangement of the perforations 9 counterbalance with the pressure loss of gas flow within the heating drum 5.

Means for increasing or decreasing the open area of the perforations such as described above may include the selection of the number of the perforations 9 of equal size or diameter and the selection for each annular wall 8 of the size or diameter of the perforations 9 while the number thereof for each annular wall 8 remains the same over the entire length of the barrel B. In addition, it can also be achieved by employing the different subtotal open areas of the perforations 9 for upper, intermediate and lower groups of the annular walls 8.

For practical purposes, a series of experiments conducted have revealed that the intended object of the present invention can be achieved if the total open area of the perforations 9 in some of the annular walls 8 positioned adjacent to the hood 18 and occupying about one third of the length of the barrel B is selected to be twice the total open area of the perforations 9 in the remaining annular walls 8. So far shown in FIGS. 3 and 4, the perforations 9 defined in each pair of the annular walls 8 which extend radially and outwardly from the respective furrow-defining wall 6 so as to incline upwardly and downwardly, respectively, that is, on respective sides of the corresponding furrow-defining wall 6, are aligned with each other with respect to the axial direction of the barrel B so that, as best shown in FIG. 4, a high temperature combustion gas stream flowing outwards from each of the perforations 9 defined in each of the upwardly inclined annular walls 8 and that emerging outwards from the respective perforation 9 defined in the respective annular wall 8 can collide with each other within the associated concave space before they become a turbulent flow of gases which may eventually spread radially outwardly from the heating drum 5.

In order for the high temperature combustion gas stream flowing from each perforation 9 to be assuredly directed towards the annular wall 8 confronting such perforation 9, the pitch P between each adjoined ridge-defining walls 7 should be within the range of $1.0 \times dr$ to $2.5 \times dr$, wherein dr represents the difference between half the outer diameter of the ridge-defining wall 7 and half the furrow-defining wall 6, that is, the difference between the maximum and minimum outer radii of the corrugated body of the barrel B, and, at the same time, the angle $\theta$ as defined hereinbefore should be within the range of 10° to 50°, provided that the perforations 9 in each annular wall 8 are circumferentially positioned intermediately of the width of the respective annular wall 8.

In addition thereto, the perforations 9 in each pair of the annular walls 8 on respective sides of the corresponding ridge-defining wall 7 are offset from each other with respect to the axial direction of the barrel B so that the high temperature gas entering each convex space, which is defined within the barrel B interiorly of the respective ridge-defining wall 7, can be distributed laterally to create different combustion gas streams one directed towards one perforation 9 in the upwardly inclined annular wall 8 on one side of each ridge-defining wall 7 and the other directed towards the adjacent perforation 9 in the downwardly inclined annular wall 8 on the other side of such ridge-defining wall 7 which is axially offset from such one perforation 9.

When the burner 3 is in operation producing combustion flames flaring upwards through the interior of the heating drum 5, the latter is heated to a red-hot condition with high temperature heat dissipating therefrom. At this time, as best shown in FIGS. 3 and 4, the combustion gases inside the heating drum 5 are emitted to the outside through the perforations 9. However, since the perforations 9 opening upwards on one side of each ridge-defining wall 7 and the perforations 9 opening downwards on the other side of such ridge-defining wall 7 are offset from each other with respect to the axial direction of the heating drum 5 as hereinbefore described, the upwardly flowing layer of the combustion gases along the inner peripheral surface of the heating drum 5 is rendered uniform and, therefore, by the heat transmission resulting from both the contact and the conduction, the heating drum 5 can be heated substantially uniformly to the elevated temperature with the consequently increased radiant heat emitted therefrom.

On the other hand, since exteriorly of the heating drum 5 the perforations 9 opening upwardly on one side of each ridge-defining wall 7 and the perforations 9 opening downwardly on one side of the next adjacent ridge-defining wall 7 confront, and are aligned, with each other, the gas streams flowing from the upwardly opening perforations 9 collide with the gas streams flowing from the downwardly opening perforations 9 to produce a turbulent flow of the high temperature gases which are subsequently diffused radially outwardly from the heating drum and, accordingly, the high temperature gases remain afloat within the respective concave space while forming a thermal boundary layer acting to keep the outer surface of the heating drum 5 substantially enclosed by the high temperature atmosphere and also to minimize the cooling of the heating drum 5 which would occur in contact with the ambient air outside the heating drum 5. Accordingly, not only can the heating drum 5 be uniformly heated, but also the amount of the radiant heat emitting from the heating drum 5 can be increased.

While the heating drum 5 according to the present invention functions, when in use, in the manner as hereinbefore described, the heating drum 5 is preferably made of steel material and is prepared from a band steel by cutting it to a desired length and welding the opposite ends thereof together in end-to-end fashion by the use of any known welding technique, for example, a seamless but-welding method. The resultant hollow steel cylinder is then axially corrugated to complete the heating drum in the manner which will be described subsequently with reference to FIGS. 7 to 9. Preferably, the heating drum 5 after the manufacture thereof is provided on its outer peripheral surface with a layer of either ceramic material or metal oxidized material for increasing the far-infrared radiating efficiency to permit heat energies to reach a far distance.

Where the ceramic material is employed for the surface layer, any known coating technique can be employed, for example, a painting technique or a plasma spray coating technique. On the other hand, where the metal oxidized material is employed for the surface layer, it can readily be formed by heating the heating drum in a furnace, for example, a radiant tube furnace, for a predetermined period of time, for example, 5 minutes, to allow the outer surface of the heating drum to be formed with the metal oxidized layer. In case of the metal oxidized surface layer employed, the heating drum 5 according to the present invention can be manufactured at lower cost than that having the ceramic surface layer.

Figure 6:
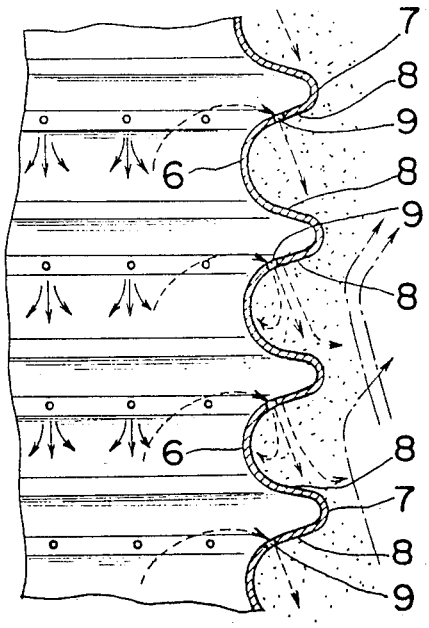
FIGS. 5 and 6 are views similar to FIG. 4, showing the heating drums according to different embodiments of the present invention, respectively.

In the foregoing embodiment, both of the annular walls 8 extending generally upwardly and downwardly, respectively, from each furrow-defining wall 6 have been described as having the respective perforations defined therein. However, either the perforations 9 in each of the annular walls 8 extending generally upwardly from the associated furrow-defining walls 6 or those in each of the annular walls 8 extending generally downwardly from the associated furrow-defining walls 6 may not be always necessary. FIG. 6 illustrates an example in which only the perforations 9 defined in the annular walls 8 extending generally upwardly from the associated furrow-defining walls 6 are employed.

Figure 5:
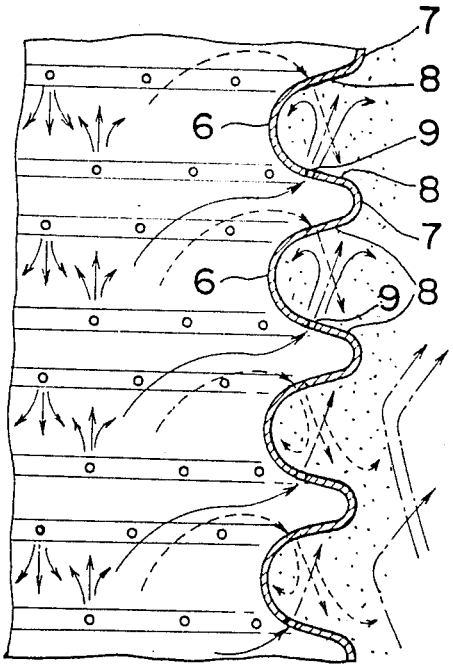

In the embodiment shown in FIG. 5, the perforations 9 defined in each annular wall 8 extending generally upwardly from the associated furrow-defining wall 6 are axially offset from and are not aligned with the perforations in the adjacent annular wall 8 extending generally downwardly from such associated furrow-defining wall 6 and confronting such each annular wall 8, and at the same time, are axially offset from and are not aligned with the perforations in the respective annular wall 8 extending generally downwardly from each next adjacent furrow-defining wall 6. In this embodiment shown in FIG. 5, for uniformly heating the heating drum 5 to a red-hot condition in a manner similar to that described in connection with the embodiment described with reference to FIGS. 3 and 4, the gas streams emerging outwards through the upwardly opening perforations 9 impinge upon the non-perforated area of the adjacent annular wall to which they face and the combustion gas streams flowing outwards through the downwardly opening perforations 9 impinge upon the non-perforated area of the adjacent wall to which they face, thereby creating turbulent flow of gases which in turn spread radially outwardly from the heating drum 5. It is to be noted that the description concerning the pitch between each two adjacent ridge-defining wall 7, which has been made in connection with the foregoing embodiment, equally applies to the heating drum 5 according to the embodiment shown in and described with reference to FIG. 5, as does the description concerning the angle $\theta$ of convergence of the annular walls 8 on respective sides of each ridge-defining wall 7.

Hereinafter, the method by which the hollow steel cylinder prepared from a band steel or hoop steel in the manner as hereinbefore described is axially corrugated to provide the generally bellows-like shape to the heating drum will be described with particular reference to FIGS. 7 to 9. According to the present invention, the hollow steel cylinder is generally processed through three working stations; a preliminary shaping station at which the cylinder is roughly corrugated, a perforating station at which the roughly corrugated cylinder is punched, or otherwise drilled, to define the perforations 9, and a final shaping station at which the corrugations on the roughly corrugated cylinder are shaped to the predetermined dimensions satisfying the required pitch P and the required angle $\theta$ of convergence.

Figure 7A:
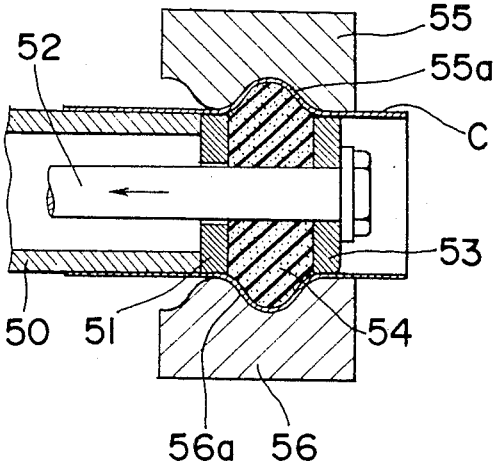
FIGS. 7(*a*) and 7(*b*) are schematic, longitudinal and sectional views of a bulging machine used to corrugate a right cylinder which would ultimately form the heating drum according to the present invention, said machine being shown in different operative positions, respectively.
Figure 7B:
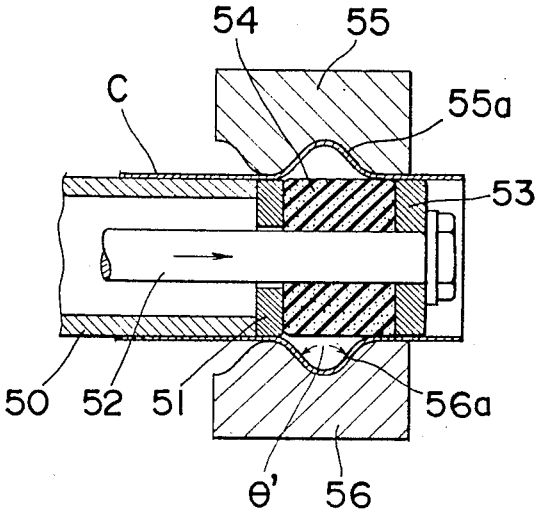

At the preliminary shaping station, the hollow cylinder generally identified by C in FIGS. 7(*a*) and 7(*b*) is mounted on a bulging machine. The bulging machine includes a cylindrical support having one end closed by a perforated end plate 51, a piston rod 52 having one end operatively coupled to a fluid operated cylinder (not shown) and the other end situated exteriorly of the cylindrical support 50 and having a retainer plate 53 mounted thereon, a generally cylindrical elastic block 54 mounted on the piston rod 52 and sandwiched and retained in position between the end plate 51 and the retainer plate 53, and a pair of press molds 55 and 56 having respective shaping cavities 55*a* and 56*a* defined therein and supported for movement in a direction close towards and away from each other. The piston rod 52 is movable between projected and retracted positions relative to the cylindrical support 50, and the elastic block 54 made of, for example, hard urethane, has an outer diameter equal to or slightly smaller than the outer diameter of the cylindrical support 50 when and so long as the piston rod 52 is in the projected position as shown in FIG. 7(*b*). By repeating a preliminary shaping process comprising the steps of mounting the hollow cylinder C on the cylindrical support 50 while both of the opposite ends thereof are retained and, hence, fixed by a retaining mechanism (not shown), driving the press molds 55 and 56 in a direction close to each other so as to encircle a portion of the hollow cylinder C radially and outwardly of the elastic block 54, moving the piston rod 52 from the projected position towards the retracted position, as shown in FIG. 7(*a*), to compress the elastic block 54 with its outer peripheral portion consequently expanded radially outwardly while that portion of the hollow cylinder C is radially outwardly pressed into the shaping cavities 55*a* and 56*a* as shown in FIG. 7(*a*), moving the piston rod 52 in the retracted position back towards the projected position and, simultaneously therewith or shortly thereafter, separating the shaping molds 55 and 56 away from each other, and transporting the hollow cylinder a predetermined axial distance relative to the cylindrical support 50, the roughly corrugated hollow cylinder can be obtained as generally indicated by Ca in FIG. 8. The number of cycles through which the above described preliminary shaping process is repeatedly performed on the hollow cylinder C depends on the number of corrugations desired to be formed on the hollow cylinder C. The extent to which the hollow cylinder C is axially corrugated by the above described preliminary shaping process is such that the angle $\theta'$ of convergence of each ridge-defining wall (which will be eventually reduced to give the particular angle $\theta$ of convergence during the final shaping process as will described later) will be about 90° or smaller than 90° so that a performing tool such as, for example, a drill or a punch, as will be described later, can be accessible to each annular side wall without being disturbed by the next adjacent ridge-defining wall as shown in FIG. 8.

The roughly corrugated cylinder Ca so obtained is subsequently transferred to the perforating station at which it is perforated to form the perforations 9 in the predetermined pattern. As best shown in FIG. 8, this can be achieved by driving the perforating tool 60 repeatedly into the roughly corrugated cylinder Ca while the latter is intermittently rotated about its own longitudinal axis, this process being intermittently repeated in a number of cycles generally twice the number of corrugations where the heating drum being manufactured is of the construction shown in FIGS. 3 and 4 or FIG. 5, or generally equal to the number of corrugations where it is of the construction shown in FIG. 6.

Figure 8:
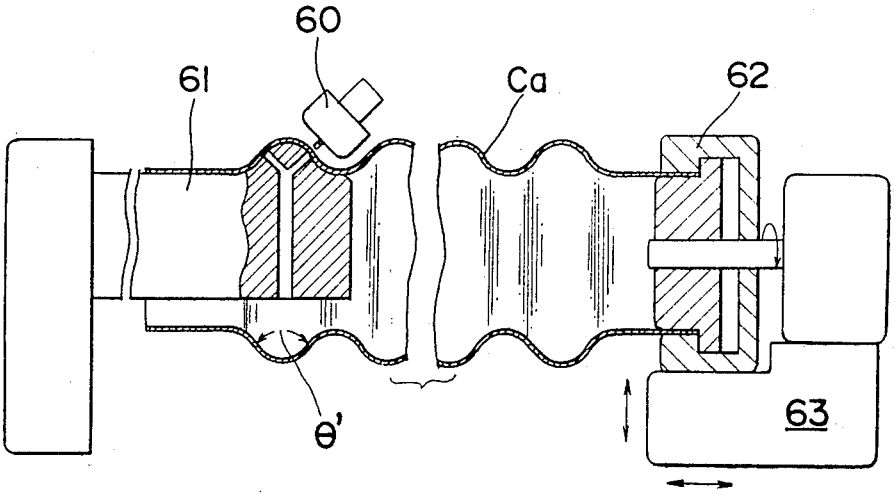
FIG. 8 is a schematic, longitudinal and sectional view showing a perforating machine used to form the perforations in the heating drum.
Figure 9:
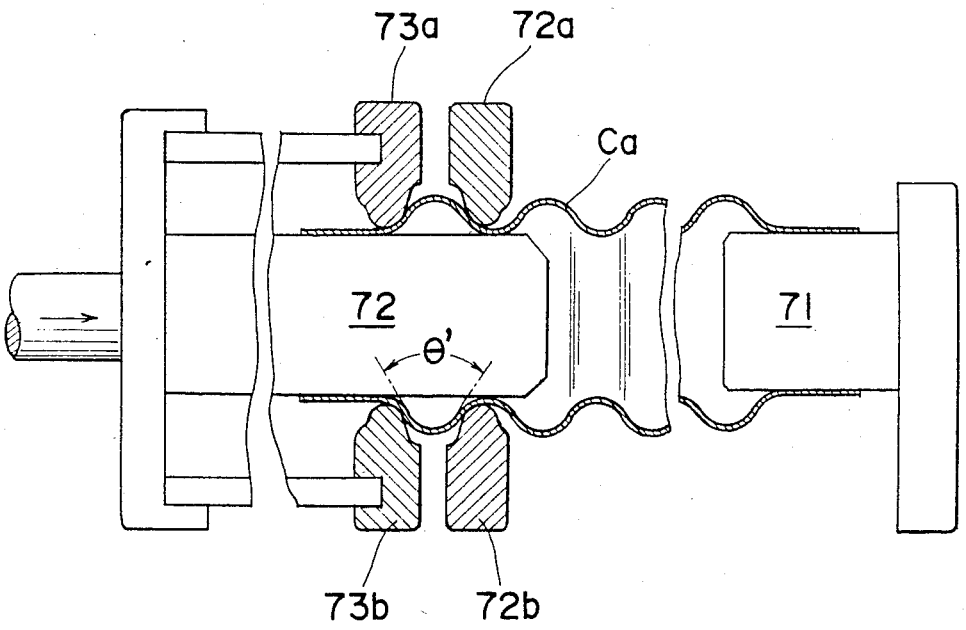
FIGS. 9(*a*) and 9(*b*) are schematic, longitudinal and sectional views showing a final shaping machine for providing the heating drum according to the present invention, said machine being shown in different operative positions, respectively.
Figure 9:
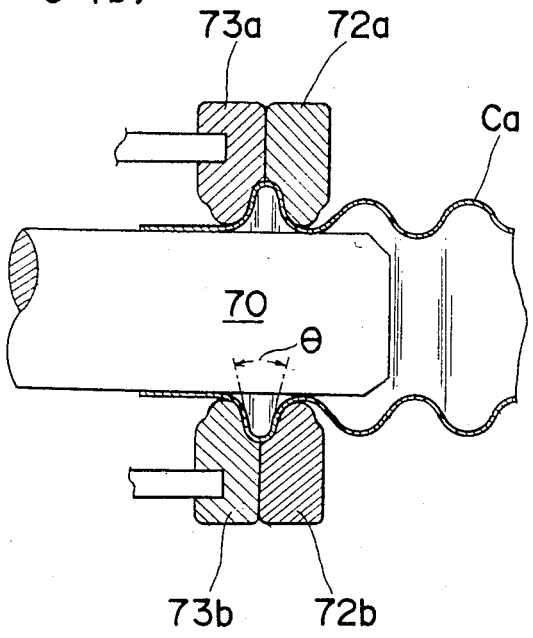

So far shown in FIG. 8, a perforating machine includes, in addition to the perforating tool 60, a chisel assembly 61 cooperable with the perforating tool to back up the wall of the roughly corrugated cylinder Ca as shown, a rotary clamper 62 for rotatably supporting the cylinder Ca at one end opposed to the chisel assembly 61, and a drive unit 63 for moving the rotary clamper 62 axially of the cylinder Ca and also in a direction perpendicular to the longitudinal sense of the chisel assembly 61.

The corrugated cylinder Ca having the perforations 9 defined therein in the manner as hereinbefore described, is then subjected to the final shaping process to provide the complete heating drum 5 having the paired annular walls 8 on respective sides of each of the ridge-defining walls 7 inclined so as to converge at the predetermined angle $\theta$ (FIG. 3) and also having each adjacent ridge-defining walls 7 spaced the predetermined pitch P (also, FIG. 3). The final shaping process basically comprises, as best shown in FIGS. 9(*a*) and 9(*b*), the steps of mounting the corrugated and perforated cylinder Ca in a manner with its opposite ends mounted on respective mandrels 70 and 71 while one of the opposite ends thereof on the mandrel 71 is fixed thereto in any suitable manner, moving a pair of stationary shaping molds 72*a* and 72*b* in a direction close to each other so as to clamp the cylinder Ca against the mandrel 70 at one of the furrows in the corrugations and, at the same time or shortly thereafter, moving a pair of movable shaping molds 73*a* and 73*b* in a direction close to each other so as to clamp the cylinder Ca against the mandrel 70 at the next adjacent furrow in the corrugations, and moving the pair of the movable shaping molds 73*a* and 73*b* in a direction close to the pair of the stationary shaping molds 72*a* and 72*b* thereby to complete the shaping of the respective ridge-defining wall as best shown in FIG. 9(*b*). After this process has been done, the pairs of the shaping molds 72*a*, 72*b* and 73*a*, 73*b* are dismantled and are then positioned in readiness for the shaping of the next adjacent ridge-defining wall. This process is repeated a number of cycles generally corresponding to the number of the corrugations in the cylinder Ca.

As hereinbefore described, the complete heating drum so manufactured may be transferred to a coating station at which the surface coating is formed on the outer peripheral surface thereof.

The present invention having been fully described above has the following advantages:

(1) Because of the unique arrangement of the perforations 9 in the heating drum 5 as hereinbefore described, the cooling of the heating drum 5 in contact with the ambient air can advantageously be minimized with no radiating efficiency reduced. Therefore, for a given radiating efficiency, the heating drum 5 according to the present invention can be manufactured in compact size and at reduced cost as compared with the conventional cylindrical heating drum of equal height.

(2) Since the heating drum 5 can be heated to a relatively high temperature, the radiant rays can reach a relatively long distance. By way of example, when the heating drum according to the present invention is heated to, for example, 500° to 600° C., the space spaced an extended distance of about 1.5 to 2.0 meters from the radiant heater embodying the present invention can be heated to 40° C.

(3) Moreover, since the heating drum can be heated to such a high temperature, unburned products of combustion which would be formed when the burner assembly is brought into in operative position can be forcibly burned by the effect of the heat remaining in the heating drum and, therefore, any possibility of generation of obnoxious smell of unburned fuel which will often occur when the burner is brought into the inoperative position can substantially be eliminated.

(4) Since the heating drum according to the present invention can be heated to a temperature of about 600° C. as compared with 450° C. to which the conventional cylindrical heating drum can be heated, the amount of radiant heat produced by the heating drum according to the present invention, expressed in terms of Q Kcal/-hour, will be increased to 2.1, namely, $$Q \propto [(600+273)/(450+273)]^4 \approx 2.1$$

according to the well known theory wherein the amount of radiant heat is proportional to the fourth power of the temperature of the heat producing medium.

Although the present invention has fully been described in connection with the preferred embodiments thereof with reference to the accompanying drawings, it is to be noted that various changes and modifications are apparent to those skilled in the art. By way of example, although in the foregoing embodiments the heating drum has been shown and described as having the perforations 9 formed circumferentially thereof, they may be formed on a portion of the drum corresponding to half the circumference thereof or one quarter of the circumference thereof. In this case, the heating drum may have a heat insulating member provided at the non-perforated area thereof, or a separate reflector member may be disposed exteriorly of and adjacent the non-perforated area of the heating drum. Such changes and modifications are to be understood as included within the scope of the present invention as defined by the appended claims unless they depart therefrom.

What is claimed is:

1. A heating drum for us in a radiant heater having a burner for the combustion of fuel, which comprises:

an axially corrugated barrel made of steel material and forming therein a generally cylindrical inner chamber and a plurality of annular chambers communicated with the cylindrical inner chamber and alternating with concave exterior spaces over the length thereof, said cylindrical inner chamber being defined by furrow-defining walls and each of said annular chambers being defined by a ridge-defining wall and opposedly inclined first and second annular side walls on respective sides of the associated ridge-defining wall;

said barrel having one end closed and the other end adapted to seat over the burner;

said barrel having first circumferential rows of combustion gas outlet perforations, the combustion gas outlet perforations of each row being defined in at least one of the first and second annular side walls for each annular chamber; and each of the combustion gas outlet perforations of all of the rows opens outwardly towards, so as to confront, the other of the first and second annular side walls of the next adjacent annular chamber such that combustion gas exiting these perforations impinge upon and heat an adjacent annular side wall.

2. A heating drum as claimed in claim 1, wherein said at least one of the first and second annular side walls for each annular chamber is the first annular side wall inclined upwardly from the associated ridge-defining wall with respect to the direction towards the closed end of the barrel.

3. A heating drum as claimed in claim 1, wherein said at least one of the first and second annular side walls for each annular chamber is the second annular side wall inclined downwardly from the associated ridge-defining wall with respect to the direction toward the closed end of the barrel.

4. A heating drum as claimed in claim 1, wherein the outer peripheral surface of the barrel is coated with a layer of ceramic material.

5. A heating drum as claimed in claim 1, wherein the outer peripheral surface of the barrel is coated with a layer of metal oxidized material.

6. A heating drum for use in a radiant heater having a burner for the combustion of fuel, which comprises:

an axially corrugated barrel made of steel material and forming therein a geneally cylindrical inner chamber and a plurality of annular chamber communicated with the cylindrical inner chamber and alternating with concave exterior spaces over the length thereof, said cylindrical inner chamber being defined by furrow-defining walls and each of said annular chamber being defined by a ridge-defining wall and opposedly inclined first and second annular side walls on respective sides of the associated ridge-defining wall;

said barrel having one end closed and the other end adapted to seat over the burner;

said barrel having first circumferential rows of combustion gas outlet perforations, the combustion gas outlet perforations of each row being defined in at least one of the first and second annular side walls for each annular chamber; and wherein another circumferential row of combustion gas outlet perforations are defined in the other of the first and second annular side walls for each annular chamber.

7. A heating drum as claimed in claim 6, wherein the combustion gas outlet perforations of each row in said one of the first and second annular side walls for each annular chamber and the combustion gas outlet perforations of each row in said other of the first and second annular side walls for the next adjacent annular chamber are aligned with each other in an axial direction of the barrel.

8. A heating drum as claimed in claim 6, wherein the combustion gas outlet perforations of each row in said one of the first and second annular side walls for each annular chamber and the combustion gas outlet perforations of each row in said other of the first and second annular side walls for the next adjacent annular chamber are offset with each other in an axial direction of the barrel.

9. A heating drum as claimed in claim 6, wherein the combustion gas outlet perforations in each row in one of the first and second annular side walls for each annular chamber and those in the other of the first and second annular side walls for the same annular chamber are aligned with each other in an axial direction of the barrel.

10. A heating drum as claimed in claim 6, wherein the combustion gas outlet perforations in each row in one of the first and second annular side walls for each annular chamber and those in the other of the first and second annular side walls for the same annular chamber are offset with each other in an axial direction of the barrel.

11. A heating drum as claimed in claim 6, wherein the first and second annular side walls for each annular chamber is inclined upwardly and downwardly with respect to the direction of the closed end of the barrel, respectively, the sum of the open areas of the perforations of each row arranged at the lower side close to the burner end being smaller than those arranged at the upper side close to the closed end.

* * * * *